US008481852B2

(12) United States Patent
Fredericksen et al.

(10) Patent No.: US 8,481,852 B2
(45) Date of Patent: Jul. 9, 2013

(54) IMPLEMENTING FLEX CIRCUIT CABLE AND CONNECTOR WITH DUAL SHIELDED AIR PLENUM

(75) Inventors: Ross T. Fredericksen, Mantorville, MN (US); Don A. Gilliland, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 199 days.

(21) Appl. No.: 13/029,424

(22) Filed: Feb. 17, 2011

(65) Prior Publication Data

US 2012/0211253 A1 Aug. 23, 2012

(51) Int. Cl.
*H01B 7/42* (2006.01)

(52) U.S. Cl.
USPC ..... 174/16.1; 174/15.1; 174/15.2; 361/694

(58) Field of Classification Search
USPC ..... 174/15.1, 15.2, 16.1; 361/694, 695, 361/699
See application file for complete search history.

(56) References Cited

U.S. PATENT DOCUMENTS 7,778,029 B2 * 8/2010 Ueno ..... 361/695
7,826,214 B2 * 11/2010 Shuy ..... 361/679.47

* cited by examiner

*Primary Examiner* — Dhirubhai R Patel
(74) *Attorney, Agent, or Firm* — Joan Pennington

(57) ABSTRACT

A method, system, and structure are provided for implementing a flex circuit cable and connector with a dual shielded air plenum. A flex circuit cable is provided with a connector. The flex circuit cable includes a stack of three spaced flex cable members with a plurality of gasket separators that are configured to form a pair of air plenums between the inner flex cable member and the respective outer flex cable members carrying cooling air coupled to the connector. The respective outer flex cable members together with the gasket separators provide a shielding function.

15 Claims, 6 Drawing Sheets

IMPLEMENTING FLEX CIRCUIT CABLE AND CONNECTOR WITH DUAL SHIELDED AIR PLENUM

FIELD OF THE INVENTION

The present invention relates generally to the data processing field, and more particularly, relates to a method, system, and structure for implementing a flex circuit cable and connector with a dual shielded air plenum used for cooling and shielding with respect to electromagnetic interference (EMI) or radio frequency interference (RFI).

DESCRIPTION OF THE RELATED ART

There is an ever increasing need to provide cool air for highly compact subassembly electronic units containing heat producing components. A unit often may be too small to contain an air-mover or fan.

In many applications there is a need to provide cool air ingress as well as hot air egress for operational heat removal and component reliability.

A need exists for an efficient and effective mechanism for implementing EMI shielding and air cooling with a flex circuit cable and connectors.

SUMMARY OF THE INVENTION

Principal aspects of the present invention are to provide a method, system, and structure for implementing flex circuit cable and connectors with a dual shielded air plenum. Other important aspects of the present invention are to provide such method, system, and structure substantially without negative effects and that overcome many of the disadvantages of prior art arrangements.

In brief, a method, system, and structure are provided for implementing a flex circuit cable and connector with a dual shielded air plenum. A flex circuit cable is provided with a connector. The flex circuit cable includes a stack of three spaced flex cable members with a plurality of gasket separators that are configured to form a pair of air plenums between the inner flex cable member and the respective outer flex cable members for carrying cooling air coupled to the connector. The respective outer flex cable members together with the gasket separators provide shielding with respect to electromagnetic interference (EMI) or radio frequency interference (RFI).

In accordance with features of the invention, the air plenums coupled to the connector optionally both provide air ingress, or respectively provide air ingress and air egress.

In accordance with features of the invention, the gasket separators optionally are formed by extensions of the respective outer flex cable members defining the shielding function.

In accordance with features of the invention, the gasket separators optionally are formed of a flexible electrically conductive material, for example, an electrically conductive fabric over foam gasket separator.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method and structure are provided for implementing a flex circuit cable and connector with a dual shielded air plenum.

Figure 1:
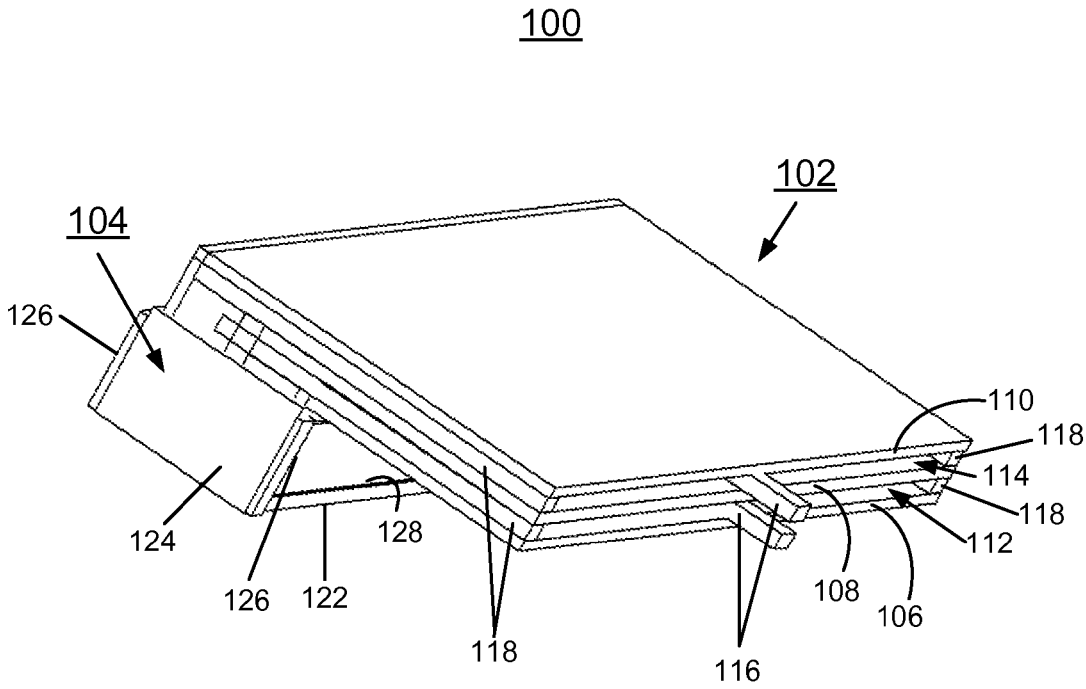
FIG. 1 is a perspective view not to scale schematically illustrating an exemplary structure for implementing a flex circuit cable and connector with a dual shielded air plenum in accordance with the preferred embodiment.
Figure 2:
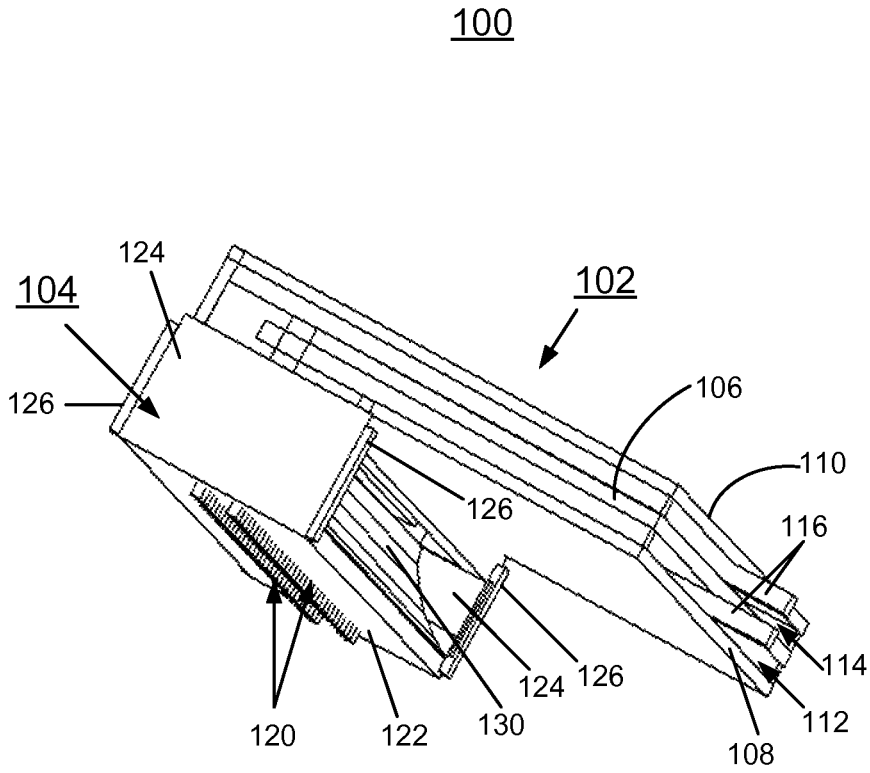
FIG. 2 is a bottom front perspective view not to scale with an opening illustrating interior detail of the connector of the an exemplary structure of FIG. 1 in accordance with the preferred embodiment.
Figure 3:
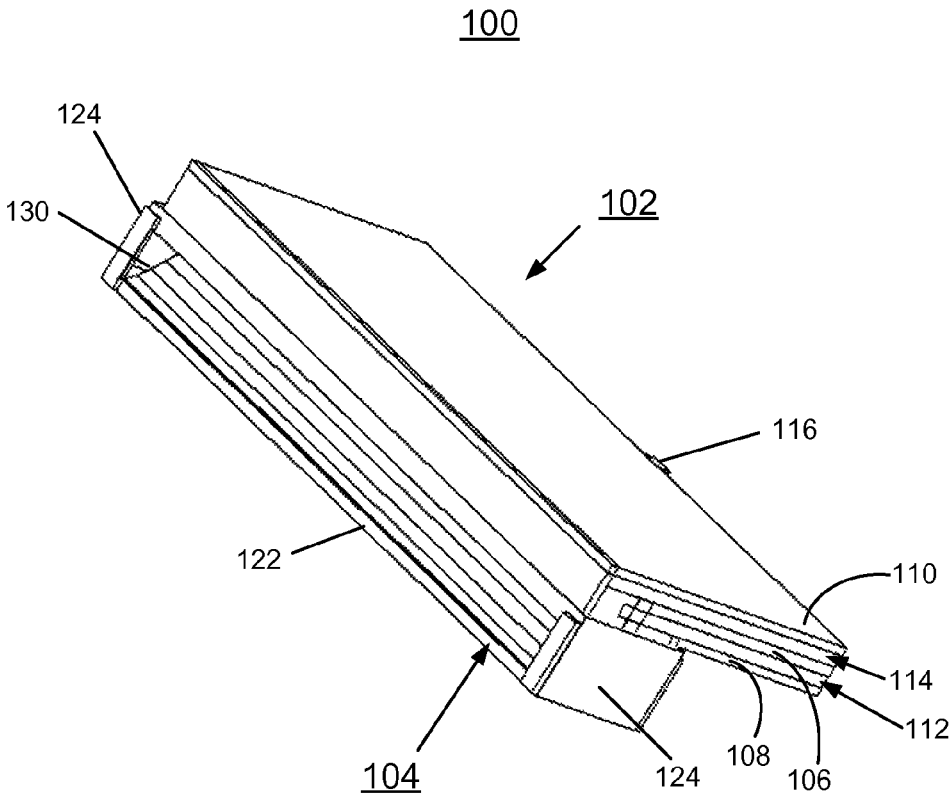
FIG. 3 is a back perspective view not to scale schematically illustrating an opening and example interior detail of the connector of the exemplary structure of FIG. 1 in accordance with the preferred embodiment.
Figure 4:
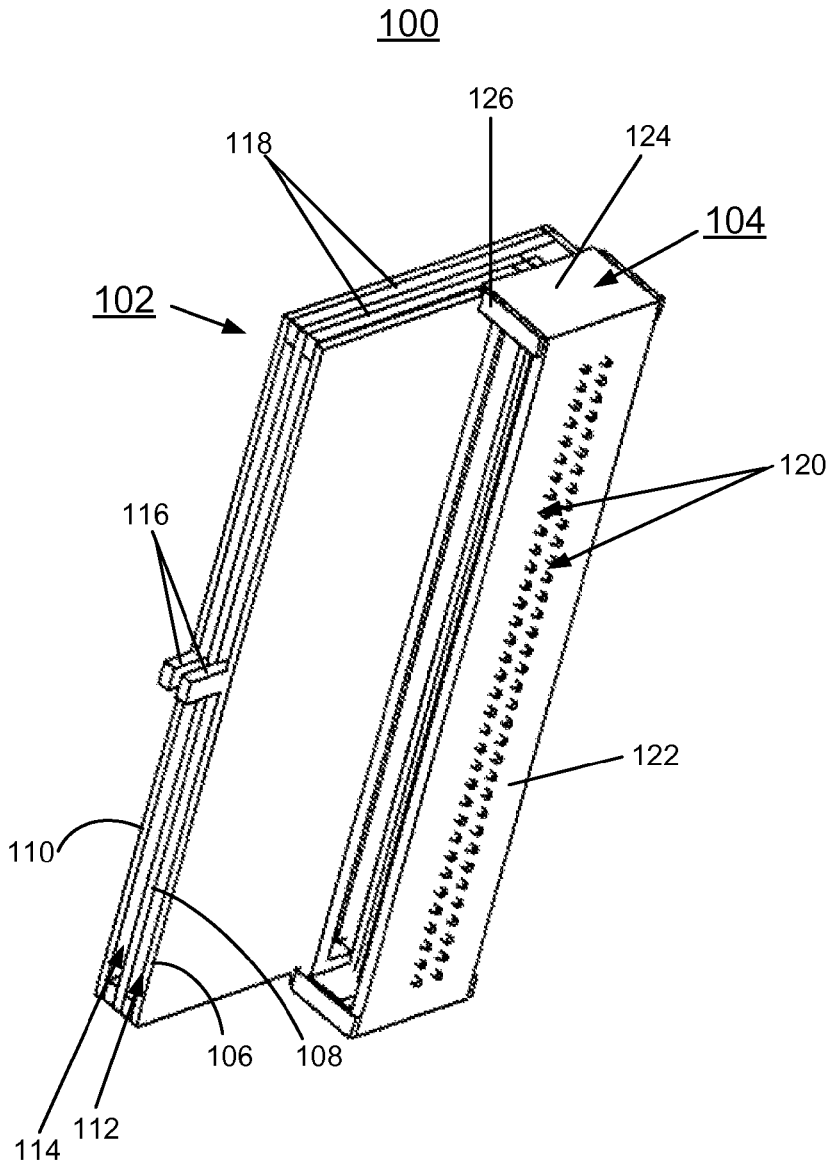
FIG. 4 is another bottom perspective view not to scale schematically illustrating the exemplary structure of FIG. 1 in accordance with the preferred embodiment.
Figure 5:
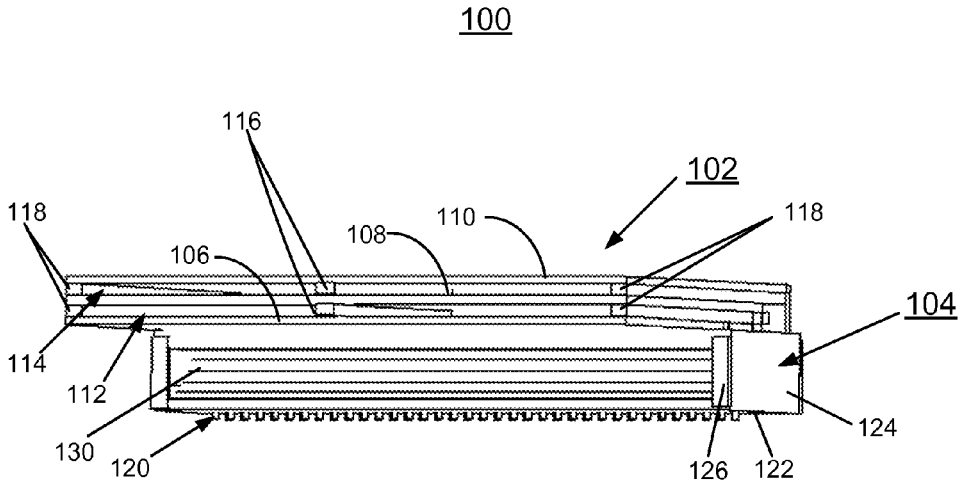
FIG. 5 is a side view not to scale schematically illustrating the exemplary structure of FIG. 1 in accordance with the preferred embodiment.
Figure 6:
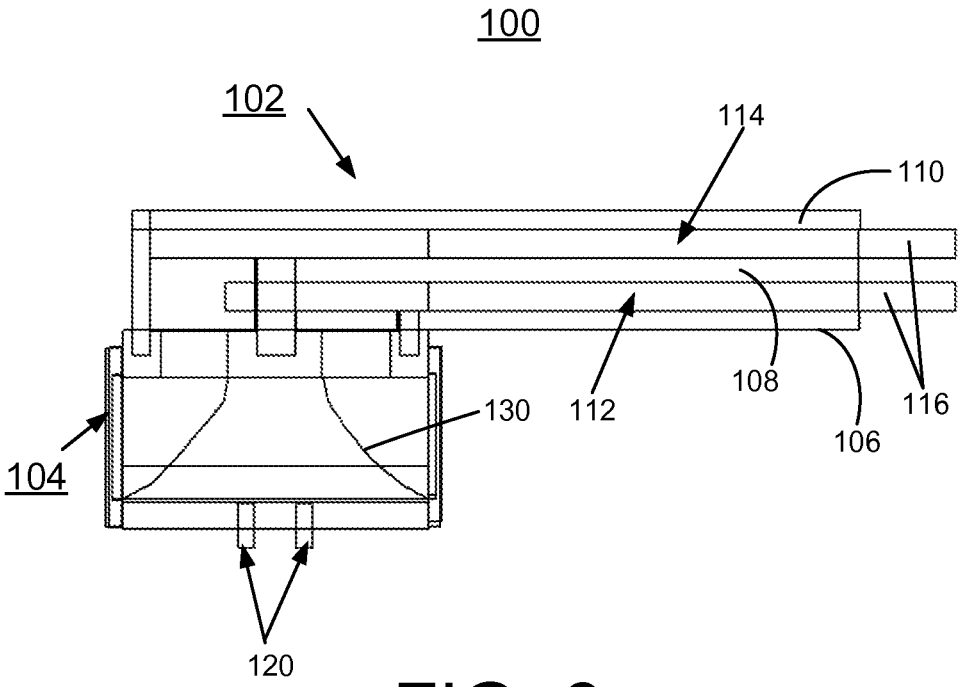
FIG. 6 is an end view not to scale schematically illustrating interior detail of the flex circuit cable and connector of the exemplary structure of FIG. 1 in accordance with the preferred embodiment.

Having reference now to the drawings, in FIG. 1, there is shown an exemplary structure or system for implementing a flex circuit cable and connector with a dual shielded air plenum generally designated by the reference character 100 in accordance with the preferred embodiment. The system or structure 100 includes a flex circuit cable generally designated by the reference character 102 and a connector generally designated by the reference character 104.

The flex circuit cable 102 includes a stack of three spaced flex cable members 106, 108, 110 that are configured to form a pair of air plenums 112, 114 between the inner flex cable member 108 and the respective outer flex cable members 106, 110 for carrying cooling air coupled to the connector 104. A respective generally centrally disposed, longitudinally extending and outwardly extending support member 116 is disposed within each of the respective air plenums 112, 114. The support members 116 provide a respective support flexible beam adding structure to keep the air plenums 112, 114 open, and prevent the air plenums 112, 114 from collapsing if the flex circuit cable 102 is bent.

The support members 116 are formed of a flexible material, such as an extruded plastic foam, or rubber. An electrically conductive fabric over foam gasket could be used to implement the support members 116, enabling electrical connection of one side of the plenum 112, 114 to the other side of the plenum.

In accordance with features of the invention, the air plenums 112, 114 optionally both provide air ingress, or respectively provide air ingress and air egress coupled to the connector 104. The respective outer flex cable members 106, 110 together with a plurality of gasket separators 118 provide shielding with respect to electromagnetic interference (EMI) or radio frequency interference (RFI).

The gasket separators 118 are conductive spacers providing a twofold function. One function of the conductive spacers 118 is to complete the shield at the edges of the flex cable members 106, 110 and a second function of the conductive spacers 118 is to keep the plenums 112, 114 open from a bend in the flex cable circuit 102. Minimum design cable radius would apply. The inner flex cable member 106 includes with signal nets or a plurality of conductors (not shown) that can be implemented, for example, with a ribbon cable, while it should be understood that the present invention is not limited to the use of a ribbon cable, various cable arrangements can be used. The two cavities or plenums 112, 114 advantageously are used to provide chilled air for cooling, carrying cooling air to the connector 104.

In accordance with features of the invention, it should be understood that the gasket separators 118 optionally are formed by extensions of the respective outer flex cable members 106, 110 defining a shield for electromagnetic interference (EMI) or radio frequency interference (RFI). The plurality of conductive spacers 118 are electrically conductive gasket separators optionally formed by an electrically conductive fabric over foam flexible material.

The dimensions of the flex circuit cable 102 vary depending upon a particular application, but example dimensions are an overall length of about 4" (10 cm), a width of about 2" (5 cm), and the flex cable members 106, 108, 110 having a thickness of about 0.015" (0.38 mm) with the support members 116 and conductive spacers 118 having a thickness of about 0.030"-0.20" (0.76 mm-0.5 cm) defining generally corresponding opening height for the plenums 112, 114.

As shown, the connector 104 includes a plurality of connector pins 120 arranged in dual rows in a bottom wall 122 of the connector. The connector includes opposed end walls 124 and opposed side wall ledges 126 defining respective openings 128. The connector 104 includes a stepped interior wall 130 extending between the bottom wall 122 and the flex circuit cable 102 for deflecting cooling air. Pins 120 are shown that exit the connector 104 in the center.

It should be understood that the present invention is not limited to the illustrated arrangement. For example, depending on available area and pressure and flow rate, if enough area is available for air movement on the end walls or end caps 124, the ends may be used for air flow. With either front or back air outlets 128 or end outlets, mesh optionally is installed to complete the EMI shielding.

In operation, for example when cooling air reaches the connector body openings 128 it is exhausted to the nearby hot component (not shown) that requires cooling. As configured, the dual air plenum 112, 114 can provide cool air ingress for subassemblies that can exhaust warm air, or for tightly enclosed units it can both supply the cool air and remove the hot exhaust.

The two respective outer flex cable members 106, 110 defining the shielding function along with the conductive spacers 118 and together with the connector 104 effectively form a faraday shield to limit emissions from the flex circuit cable 102.

The two respective outer flex cable members 106, 110 include, for example, a thin conductive layer that is formed by an electrically conductive material, such as copper, and an electrically insulative substrate that is formed by a flexible electrically insulative material, such as a polymer, including polyester or polyimide, such as a Kapton, flexible electrically insulative film.

An advantage of the present invention is that the shields defined by the outer flex cable members 106, 110 with the conductive spacers 118, and together with the connector 104, defining the shielding function are spaced apart from and not located in close proximity to the signal nets and connector pins 120 in the connector 104, helping to increase the shielding effectiveness. The shielding of the present invention has the advantage of adding enough distance such that the center flex cable members 108 is not within the skin depth of the impinging signal, thus adding more shielding effectiveness to the structure 100.

It should be understood that the present invention can include a multitude of air movers and various multiple configurations are possible to provide air through the flex plenums 112, 114 as would be understood by one of skill in the art.

It should be understood that the present invention can include components (not shown) that can be placed along the length of the interior flex cable member 108. These components can be cooled by the novel structure of the air plenum 112, 114. The chilled air can be localized onto these components.

While the present invention has been described with reference to the details of the embodiments of the invention shown in the drawing, these details are not intended to limit the scope of the invention as claimed in the appended claims.

What is claimed is:

1. A structure for implementing shielded air plenums comprising:

a flex circuit cable;

a connector connected to said flex circuit cable;

said flex circuit cable including a stack of spaced flex cable members; and a plurality of gasket separators extending longitudinally along the edges of the respective outer flex cable members and an inner flex cable member of the stack of spaced flex cable members providing shielding and configured to form a pair of air plenums between the inner flex cable member and the respective outer flex cable members for carrying cooling air coupled to said connector.

2. The structure as recited in claim 1 wherein said plurality of gasket separators are formed of an electrically conductive fabric over foam flexible material.

3. The structure as recited in claim 1 wherein said respective outer flex cable members include an electrically conductive material layer and an electrically insulative substrate.

4. The structure as recited in claim 3 wherein said electrically insulative material includes a flexible polyimide electrically insulative film.

5. The structure as recited in claim 3 wherein said electrically conductive layer includes a copper layer.

6. The structure as recited in claim 1 wherein said plurality of gasket separators are formed extensions of said respective outer flex cable members.

7. The structure as recited in claim 1 includes a generally centrally disposed, longitudinally extending support member disposed within said respective air plenums.

8. The structure as recited in claim 7 wherein said support member provides a support flexible beam adding structure to keep the air plenums open.

9. The structure as recited in claim 7 wherein said support member is formed of a flexible plastic material.

10. A method for implementing shielded air plenums comprising:

providing a flex circuit cable, and connecting said flex circuit cable to a connector;

providing said flex circuit cable includes providing a stack of spaced flex cable members; and providing shielding and forming a pair of air plenums between an inner flex cable member and the respective outer flex cable members for carrying cooling air coupled to said connector by providing a plurality of gasket separators extending longitudinally along the edges of the respective outer flex cable members and the inner flex cable member of the stack of spaced flex cable members.

11. The method as recited in claim 10 further includes providing a generally centrally disposed, longitudinally extending support member disposed within said respective air plenums.

12. The method as recited in claim 11 wherein providing said generally centrally disposed, longitudinally extending support member includes forming said support member of a flexible plastic material.

13. The method as recited in claim 10 wherein providing a plurality of gasket separators includes forming said plurality of gasket separators with extensions of said respective outer flex cable members.

14. The method as recited in claim 10 wherein providing a plurality of gasket separators includes forming said plurality of gasket separators of an electrically conductive fabric over foam flexible material.

15. The method as recited in claim 10 wherein providing a stack of spaced flex cable members includes forming respective outer flex cable members of an electrically conductive layer formed by and an electrically insulative layer.

* * * * *